United States Patent [19]

Tanaka et al.

[11] Patent Number: 4,993,392

[45] Date of Patent: Feb. 19, 1991

[54] APPARATUS FOR CONTROLLING HEATER FOR HEATING OXYGEN SENSOR

[75] Inventors: Hiroshi Tanaka; Koichi Hoshi; Masaru Goudo; Mitsuhiro Suzuki; Ritsuo Masaki, all of Susono, Japan

[73] Assignee: Toyota Jidosha Kabushiki Kaisha, Toyota, Japan

[21] Appl. No.: 503,833

[22] Filed: Apr. 3, 1990

[30] Foreign Application Priority Data

Apr. 24, 1989 [JP] Japan ..... 64-104159
Jul. 28, 1989 [JP] Japan ..... 64-197528

[51] Int. Cl.[5] ..... F02M 51/00
[52] U.S. Cl. ..... 123/489
[58] Field of Search ..... 123/489, 440; 204/425, 204/428, 406

[56] References Cited

U.S. PATENT DOCUMENTS 4,715,343 12/1987 Kinoshida ..... 123/489
4,895,123 1/1990 Uchinami et al. ..... 123/489
4,935,196 7/1990 Hoshi et al. ..... 123/489
4,947,819 8/1990 Takahashi et al. ..... 123/489

FOREIGN PATENT DOCUMENTS 197459 12/1982 Japan ..... 123/489
42963 3/1984 Japan ..... 123/489
164241 8/1985 Japan ..... 123/489
202348 10/1985 Japan ..... 123/489

*Primary Examiner*—Raymond A. Nelli
*Attorney, Agent, or Firm*—Edward W. Greason

[57] ABSTRACT

An apparatus for controlling a heater for heating an oxygen sensor provided in an exhaust gas flow passage of an internal combustion engine disposed in an automotive vehicle includes a detection circuit, a decision circuit and a power supply control circuit. The monitor circuit detects a driving condition parameter of the automotive vehicle. The decision circuit determines, from a driving condition represented by the driving condition parameter detected by the detecting circuit, whether or not a power supply control to the heater should be executed. The power supply control circuit supplies, during a predetermined period of time, the heater with an amount of power which is smaller than that to be supplied thereto in a normal driving condition when it is determined that the power supply control to the heater should be executed by the decision circuit so that a resistance value of said heater is controlled to a target resistance value.

17 Claims, 11 Drawing Sheets

| |
|---|
| FIG.5A |
| FIG.5B |

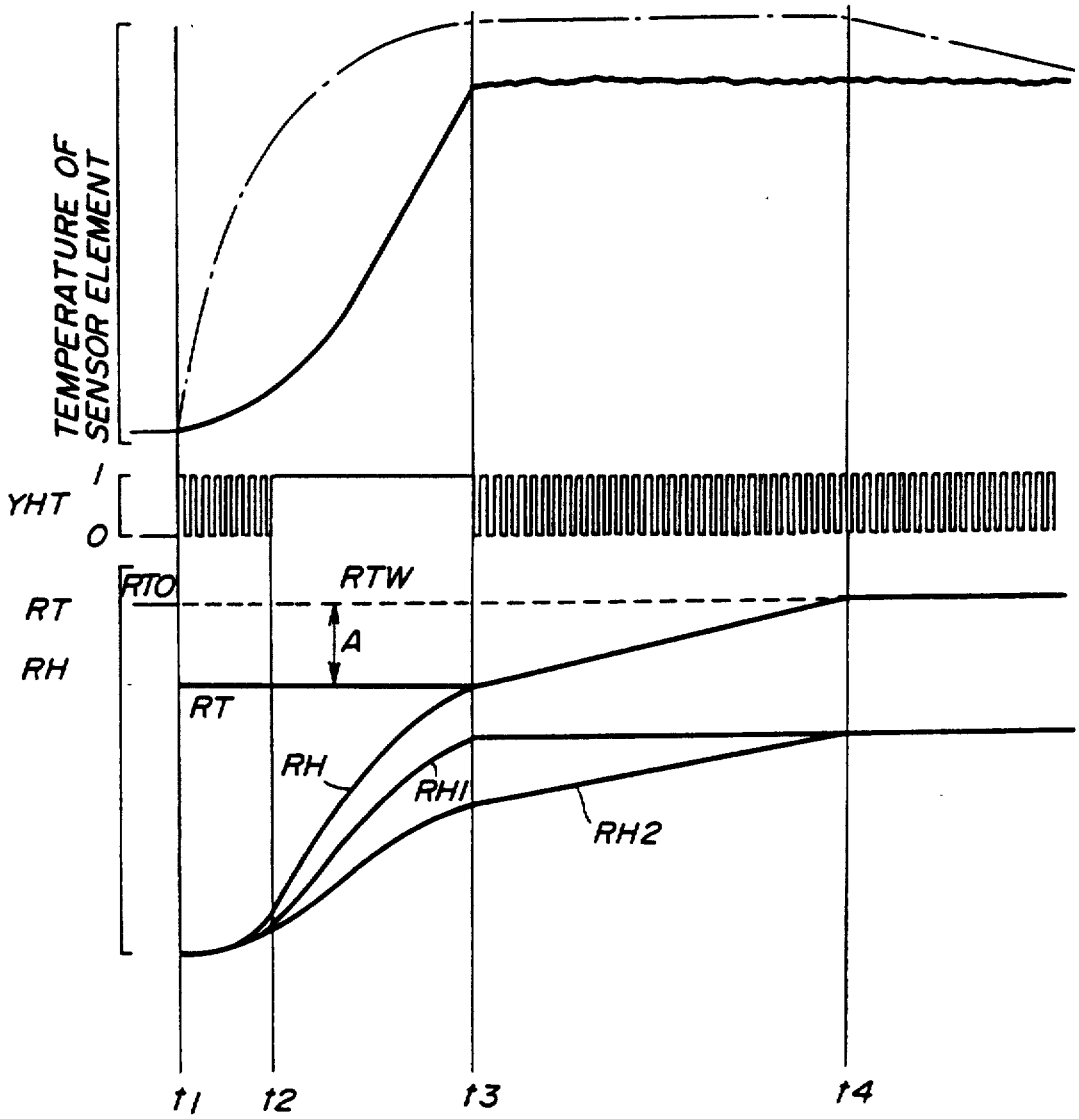
TEMPERATURE OF SENSOR ELEMENT
YHT
1
0
RTO
RTW
RT
RH
A
RT
RH
RH1
RH2
t1
t2
t3
t4

APPARATUS FOR CONTROLLING HEATER FOR HEATING OXYGEN SENSOR

BACKGROUND OF THE INVENTION (1) Field of the Invention

The present invention generally relates to an apparatus for controlling a heater for heating an oxygen sensor used in an internal combustion engine for measuring an air-fuel ratio in an exhaust gas.

(2) Description of the Prior Art

Recently, various control devices have been developed which are directed to an improvement in output power of an internal combustion engine, a reduction of fuel consumption or clarifying exhaust gas. Such control devices employ oxygen sensors without exception. As is well known, an oxygen sensor is used for measuring the concentration of an oxygen component contained in the exhaust gas. An oxygen sensor has a sensor element (sense portion) formed of a solid electrolyte or a semiconductor. An output signal of the oxygen sensor depends on the temperature of the sensor element thereof.

It is known that an oxygen sensor having a sensor element made of titania ($TiO_2$) has an air-fuel ratio (A/F) characteristic as a temperature function of the sensor element as shown in the graph of FIG. 1. The vertical axis of the graph represents the air-fuel ratio, and the horizontal axis thereof represents the temperature of the sensor element. A stoichiometric air-fuel ratio exists between air-fuel ratios $a_1$ and $a_2$. When the actual air-fuel ratio is equal to or smaller than the air-fuel ratio $a_1$ (a rich air-fuel ratio), a large amount of hydro carbon (HC) is contained in the exhaust gas. In contrast, when the actual air-fuel ratio is equal to or larger than the air-fuel ratio $a_2$ (a lean air-fuel ratio), a large amount of nitric oxide ($NO_x$) is contained in the exhaust gas. It can be seen from the graph of FIG. 1 that the temperature of the sensor element must be regulated so that it is maintained within the narrow temperature range between T1 and T2 so that the air-fuel ratio of the titania oxygen sensor can be kept within the narrow range between $a_1$ and $a_2$ including the stoichiometric air-fuel ratio.

From this viewpoint, a conventional oxygen sensor is equipped with a heater, which is subjected to a power supply control so that the value of resistance of the heater becomes equal to a definite resistance value. When the resistance value of the heater is regulated at the definite resistance value, the temperature of the sensor element is also regulated at a constant temperature. Such a power supply control is disclosed in Japanese Laid-Open Pat. Application Nos. 57-197459, 60-164241 or 60-202348, for example.

However, the aforementioned conventional temperature control of the oxygen sensor has the disadvantages described below. The temperature of the oxygen sensor is regulated due to the fact that the resistance value of the heater incorporated therein varies in accordance with a change of the temperature of the heater. It has been found from the inventors' careful study that it is difficult to regulate the temperature of the sensor element immediately after current supply to the heater is started by only controlling the resistance value of the heater so that it becomes equal to the definite value.

The above-mentioned problem arises from the structure of the heater. The resistance of the heater equals the sum of a resistance of a leading end portion thereof arranged in the vicinity of the sensor element and a resistance of a rear end portion thereof which is located close to a mounting portion of the oxygen sensor through which the oxygen sensor is fastened to an exhaust gas passage. In addition, the temperature of the heater leading end portion increases faster than that of the heater rear end portion due to different thermal capacities thereof. Thus, the heater resistance value obtained immediately after the current supply to the heater is actually started, shows a temperature lower than the temperature of the heater leading end portion. When the power supply to the heater is regulated so as to be equal to the definite value (target resistance value) for a while after the power supply to the heater is started, the temperature of the sensor element of the oxygen sensor increases over a target temperature (normal working temperature), or in other words, overshoots. The occurrence of overshooting the target temperature of the sensor element deteriorates precision in measuring the air-fuel ratio.

SUMMARY OF THE INVENTION

It is a general object of the present invention to provide an improved apparatus for controlling a heater for heating an oxygen sensor in which the aforementioned disadvantages are overcome.

A more specific object of the present invention is to provide an apparatus for controlling a heater for heating an oxygen sensor capable of controlling the temperature of the sensor element of the oxygen sensor without overshooting immediately after the power supply to the heater is started.

The above-mentioned objects of the present invention are achieved by an apparatus for controlling a heater for heating an oxygen sensor provided in an exhaust gas flow passage of an internal combustion engine disposed in an automotive vehicle which includes a detection circuit, a decision circuit and a power supply control circuit. The monitor circuit detects a driving condition parameter of the automotive vehicle. The decision circuit determines, from a driving condition represented by the driving condition parameter detected by the detecting circuit, whether or not a power supply control to the heater should be executed. The power supply control circuit supplies the heater, during a predetermined period of time, with an amount of power which is less than that to be supplied thereto in a normal driving condition when it is determined that the power supply control to the heater should be executed by the decision circuit so that a resistance value of the heater is controlled to a target resistance value.

BRIEF DESCRIPTION OF THE DRAWINGS

Additional objects, features and advantages of the present invention will become apparent from the following detailed description when read in conjunction with the accompanying drawings, wherein:

FIG. 10 is a time chart illustrating variations in parameters used for executing the heater control process shown in FIGS. 5A and 5B;

DESCRIPTION OF THE PREFERRED EMBODIMENTS

Figure 1:
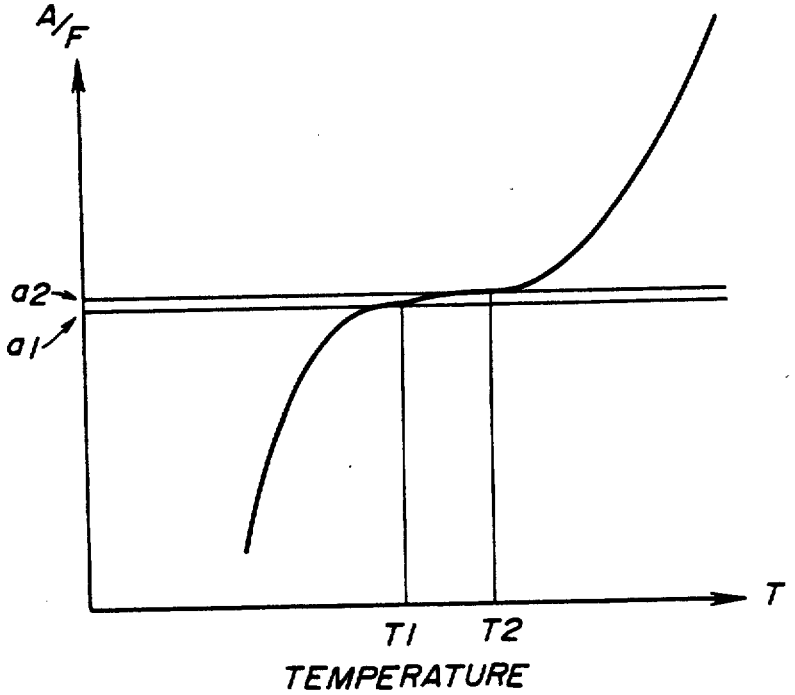
FIG. 1 is a graph illustrating the relationship between the temperature of a sensor element of an oxygen sensor and the actual air-fuel ratio.
Figure 2:
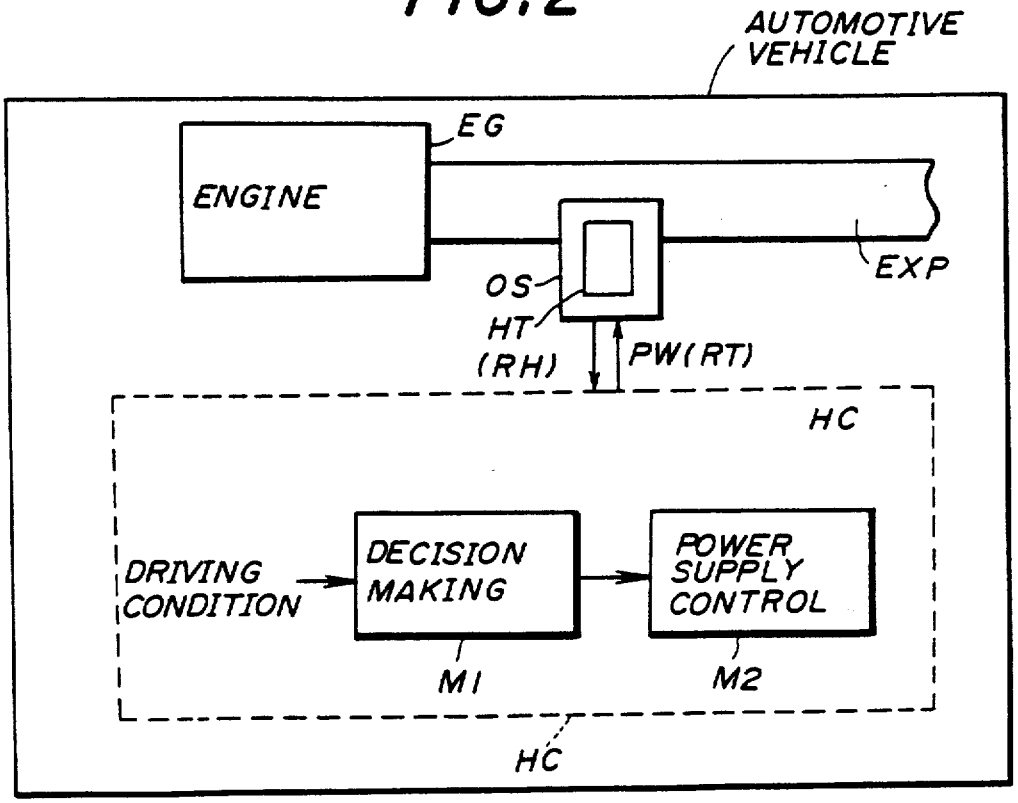
FIG. 2 is a block diagram illustrating an outline of the present invention.

A description will be given of an outline of the present invention with reference to FIG. 2. An automotive vehicle has an internal combustion engine EG, an oxygen sensor OS fastened to an exhaust gas flow passage EXP and a heater control apparatus HC. The heater control apparatus HC measures the resistance value RH of a heater HT incorporated in the oxygen sensor OS and control power PW to be supplied to the heater HT in such a way that the resistance value RH of the heater HT is always equal to a predetermined target resistance value RT. According to the present invention, the heater control apparatus HC includes a decision circuit M1, which makes a decision on whether or not an initial stage of a power supply control to the heater HT of the oxygen sensor OS (an initial power supply control) should be performed, on the basis of a driving condition of the automotive vehicle. Further, the heater control apparatus HC includes a power control circuit M2, which supplies the heater HT with a reduced amount of power as compared with a normal amount of power supply during a predetermined period when it is decided that the initial power supply control should be carried out.

While the automotive vehicle is being driven normally, power PW to be supplied to the heater HT is controlled by a normal power supply control so that the resistance value RH of the heater HT is always equal to the target resistance value RT. By this control, the temperature of a sensor element of the oxygen sensor OS is maintained constant so that the concentration of the oxygen component in an exhaust gas can be measured with high precision.

On the other hand, the initial power supply control to the heater HT is carried out only when the driving condition of the automotive vehicle falls in a predetermined driving condition. On the other hand, the power supply control is made inactive, for example, while a starter motor (not shown) is operating, or during a predetermined time after the engine EG is started under a condition where the temperature of the engine EG is extremely low. The decision circuit M1 determines whether or not the initial power supply control to the heater HT should be carried out, referring to the current driving condition of the vehicle. When the result is affirmative, the power control circuit M2 reduces the amount of power PW to be supplied to the heater HT only during a predetermined time immediately after the decision is made. Thereby, an increase of the temperature of a leading end portion of the heater HT is suppressed so that the temperature of the sensor element of the oxygen sensor OS can be prevented from overshooting a normal working temperature thereof.

Figure 3:
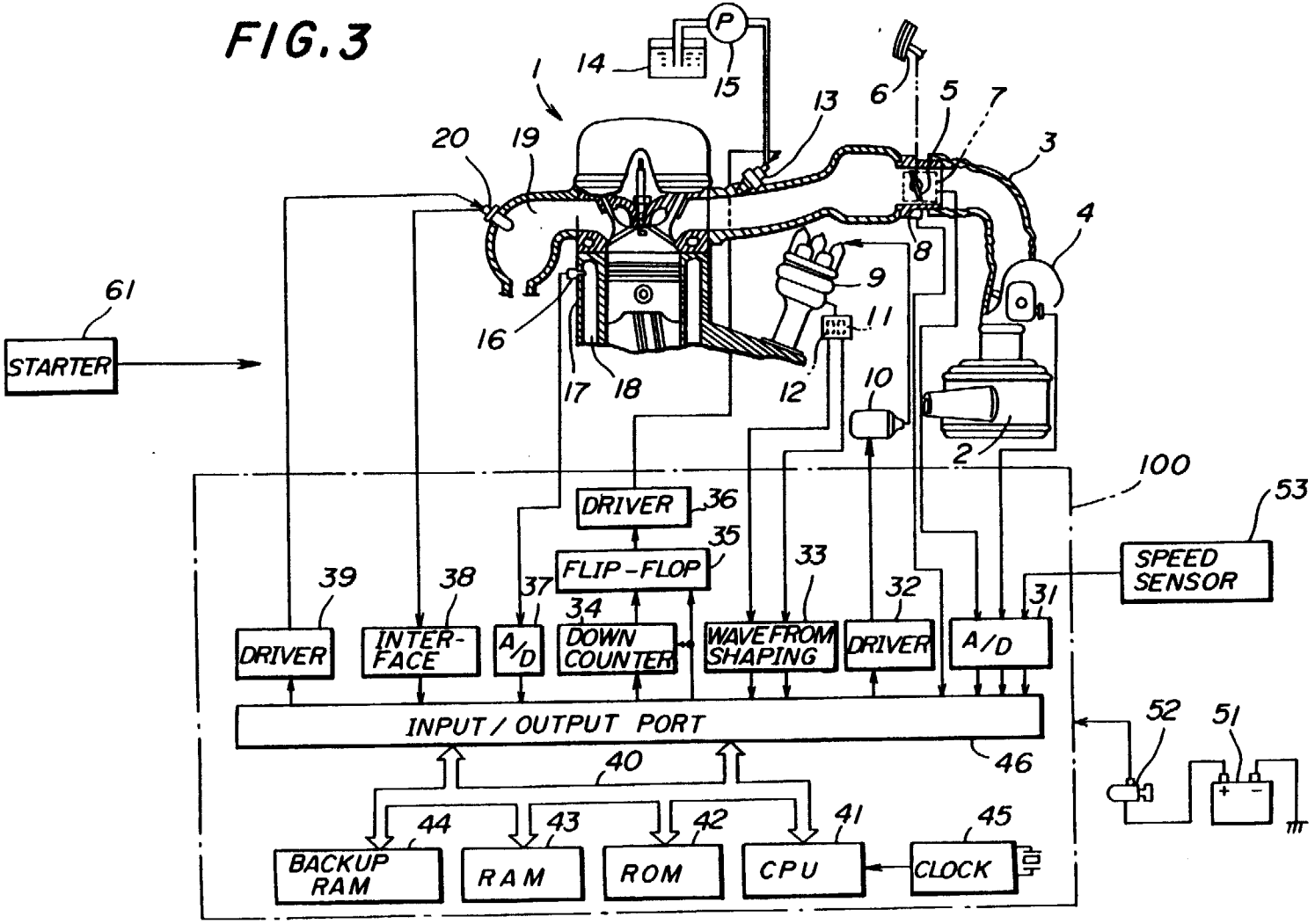
FIG. 3 is a schematic diagram of an internal combustion engine to which the present invention is applied.

A description will be given of a first preferred embodiment of the present invention. Referring to FIG. 3, there is illustrated an internal combustion engine 1 such as a four-cycle spark ignition engine disposed in an automotive vehicle. Air passes through an air cleaner 2, and is taken into an air-intake passage 3 of the engine 1. An airflow sensor 4 of a potentiometer type, which is provided in the air-intake passage 3, detects the amount of air taken into the engine 1 to generate an analog voltage signal in proportion to the amount of air flowing therethrough. The analog voltage signal derived from the airflow sensor 4 is sent to a multiplexer-incorporating analog-to-digital (A/D) converter 31 of a control circuit 100. An output signal of a speed sensor 53 is supplied to the A/D converter 53. A throttle valve 5 cooperating with an accelerator pedal 6 is provided in the air-intake passage 3. The position of the throttle valve 5 is detected by a throttle position sensor 7, an output signal of which is supplied to the A/D converter 31. An idle switch 8 is fastened to the air-intake passage 3. An output signal of the idle switch 8 is transmitted to an input/output port 46 of the control circuit 100.

A distributor 9 distributes a high voltage generated by an igniter 10 to cylinders of the engine 1. The igniter 10 is driven by a driver circuit 32 connected to the input/output port 46. Disposed in the distributor 9 are crank angle sensors 11 and 12, each of which detects the angle of a crank shaft (not shown) of the engine 1. For example, the crank angle sensor 11 generates a pulse signal at every 720° crank angle, and the crank angle sensor 12 generates a pulse signal at every 30° crank angle. The pulse signals supplied from the crank angle sensors 11 and 12 are sent to a waveform shaping circuit 33 connected to the input/output port 46 of the control circuit 100.

Provided in the air-intake passage 3 is a fuel injection valve 13 for supplying pressurized fuel from a fuel tank 14 through a fuel pump 15 to an air-intake port of the illustrated cylinder of the engine 1. It is noted that other fuel injection valves are provided for the other cylinders, not shown in FIG. 3. The fuel injection valve 13 is controlled by a down counter 34, a flip-flop 35 and a driver circuit 36 provided in the control circuit 100. A fuel injection amount calculated by a central processing unit (hereafter simply referred to as a CPU) 41 is preset in the down counter 34 through an internal bus 40 and simultaneously the flip-flop 35 is set so that the fuel injection valve 13 is made active by the driver circuit 36. The down counter 34 counts down a clock signal generated by a clock generator 45 from the preset value and generates a logic "1" signal when the counter value reaches zero. At this time, the flip-flop 35 is reset so that the driver circuit 36 stops the activation of the fuel-injection valve 13. Thus, the amount of fuel which corresponds to the aforementioned fuel injection amount is injected into the air-intake port of the cylinder through the fuel injection valve 13.

A coolant temperature sensor 16 for measuring the temperature of a coolant 18 is disposed in a cylinder block 17 of the engine 1. The coolant temperature sensor 16 outputs an analog voltage signal based on the temperature of the coolant 18, and transmits it to an A/D converter 37 of the control circuit 100.

Provided in an exhaust gas flow passage 11 is an oxygen ($O_2$) sensor 20 for detecting the concentration of an oxygen component in an exhaust gas from the cylinder of the engine 1. The oxygen sensor 20 has a heater (not shown in FIG. 3) and a sensor element sensitive to the oxygen component. A signal showing the current resistance value of the heater and a signal from the sensor element are sent to an interface circuit 38 connected to the input/output port 46. The power supply control to the heater of the oxygen sensor 20 is controlled through a driver circuit 39 as will be described in detail later.

The control circuit 100 further comprises a read only memory (hereafter simply referred to as a ROM) 42, a random access memory (hereafter simply referred to as a RAM) 43 and a battery backup random access memory (hereafter simply referred to as a backup RAM) 44. The ROM 42 stores a main routine, a sub-routine, tables (maps), constants, etc. The RAM 43 stores temporary data, and the backup RAM 44 stores backup data. Electric power (energy) derived from a battery 51 is supplied to the control circuit 100 via an ignition switch 52. The bus 40, the CPU 41, the ROM 42, the RAM 43, the backup ROM 44, the clock generator 45 and the input-/output port 46 may be implemented by a microcomputer.

Figure 4:
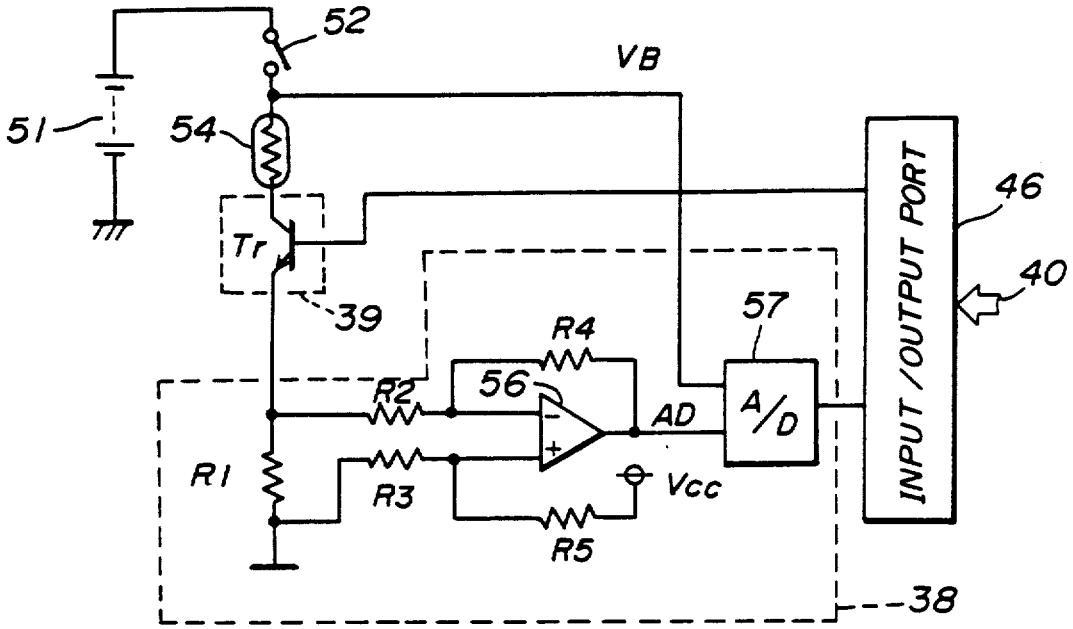
FIG. 4 is a circuit diagram of an interface circuit and a driver circuit shown in FIG. 3.

FIG. 4 illustrates a peripheral circuit of the heater incorporated in the oxygen sensor 20. Reference numeral 54 designates the heater incorporated in the oxygen sensor 20. One end of the heater 54 is connected to a contact of the ignition switch 52 and the other end thereof is connected to a collector of a switching (power) transistor Tr which configures the driver circuit 39. A base of the switching transistor Tr is connected to the input/output port 46 and is controlled as will be described in detail later. The interface circuit includes an operational amplifier 56 and an A/D converter 57. A comparison resistor R1 is connected between an emitter of the switching transistor 39 and ground. A potential difference across the comparison resistor R1 with respect to the ground potential is applied to inverting and non-inverting input terminals of the operational amplifier 56 through resistors R2 and R3. An output terminal of the operational amplifier 56 is coupled to the inverting input terminal thereof through a resistor R4 and the input terminal of the A/D converter 57. The output terminal of the input/output port 46 is connected to the A/D converter 57. A reference voltage is formed by a positive power source voltage Vcc and a resistor R5, and is applied to the non-inverting input terminal of the operational amplifier 56. The heater 54 is connected to the A/D converter 57. Reference AD denotes an output signal of the A/D converter 57, and reference VB denotes a battery voltage.

The output signal of the sensor element of the oxygen sensor 20 is supplied to the input/output port 46 through a buffer circuit and a comparison circuit, as is disclosed in U.S. Pat. No. 4,715,343, the disclosure of which is hereby incorporated by reference.

A description will be given of a heater control processing routine. The heater control uses the signals supplied from the idle switch 8, the speed sensor 53, the coolant temperature sensor 16, the airflow sensor 4 and the crank angle sensors 11 and 12 (the engine rotational speed). Further, the heater control uses a fuel injection signal supplied to the down-counter 34 and an ignition timing signal supplied to the driver circuit 32.

Figures 5, 5A:
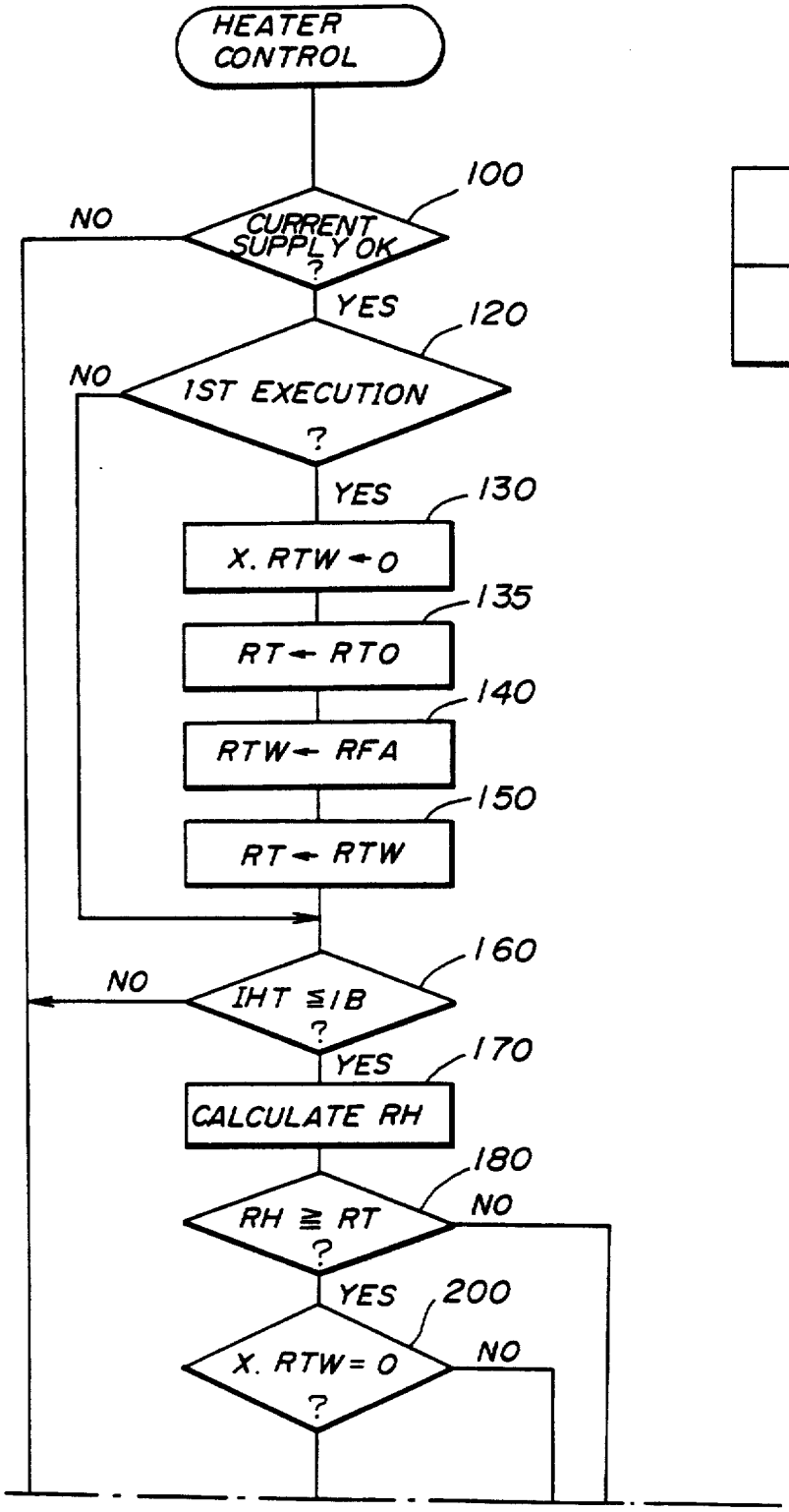
FIG. 5 is a view illustrating how to combine FIGS. 5A and 5B.
FIGS. 5A and 5B are flowcharts illustrating a heater control processing routine which is executed by a central processing unit (CPU) shown in FIG. 3 according to a first embodiment of the present invention.
Figure 5B:
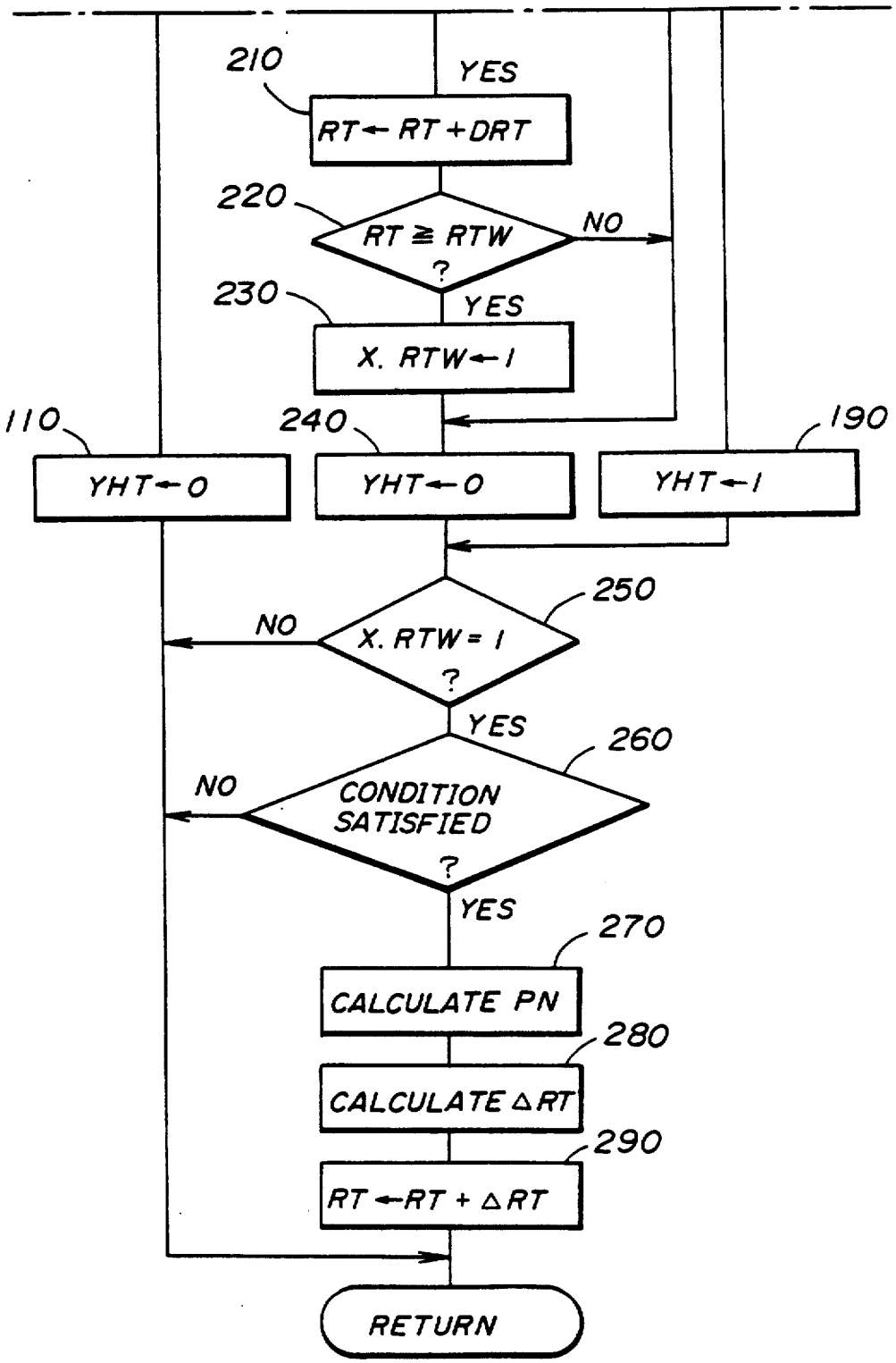

FIGS. 5A and 5B are flowcharts illustrating the heater control processing routine. The CPU 41 (FIG. 3) executes the illustrated routine at every predetermined time period, such as 64 milliseconds. At the commencement of the routine, it is determined whether or not current should be supplied to the heater 54 on the basis of a current driving condition (step 100). Current is supplied to the heater 54, or in other words, the switching transistor Tr (FIG. 4) is turned ON when a starter motor 61 (FIG. 3) is made inactive, the voltage of the battery 51 is equal to or higher than a predetermined voltage, and the coolant temperature is equal to or higher than a predetermined coolant temperature. When it is judged at step 100 that current should not be supplied to the heater 54, the control proceeds to step 110 (FIG. 5B), which sets a variable YHT to a value of 0. A signal corresponding to the value of the variable YHT is supplied to the switching transistor Tr from the input/output port 46 in accordance with a different routine, which will be described later. When the variable YHT is set to 0, the switching transistor Tr is turned OFF so that the current supply to the heater 54 is stopped.

On the other hand, when the result at step 100 is YES, the control proceeds to step 120, which determines whether or not the execution of the present routine is the first execution after it is judged that the heater 54 should be supplied with current. A description is now given of a cycle of the first execution which is to be executed after it is decided that the heater 54 should be supplied with current.

At step 130, a flag X.RTW is set to 0. When the flag X.RTW is 0, it indicates a time immediately after the present power supply control is started. On the other hand, when the flag X.RTW is 1, it indicates a normal period of time after the above-mentioned time.

At step 135 following step 130, a heater control target resistance value RTO which is set at the end of the previous driving step is read out from the backup RAM 44, and set in a target resistance value variable RT. At step 140, a definite value A is subtracted from the value in the variable RT, and the resultant value is set in a conservation variable RTW. The value to be set in the conservation variable (or the definite value A) is predetermined by experiments or computer simulation, taking into account the following matter. As described previously, there is a difference in temperature increasing speed between the sensor element and the mounting portion of the oxygen sensor due to the difference in thermal capacity therebetween. In actuality, the temperature of the sensor element increases faster than that of the mounting portion. The resistance value RH of the heater 54 equals the sum of the resistance value RH1 of the sensor element and the resistance value RH2 of the mounting portion. Thus, when current is successively supplied to the heater 54 until the target resistance value corresponding to the normal working temperature is obtained, the temperature of the sensor element overhoots the normal working temperature. From this oint of view, the value to be set in the conservation ariable RTW or the definite value A is selected, taking nto consideration the difference in temperature increasing speed between the sensor element and the mounting ortion so that the temperature of the sensor element an reach the normal working temperature without ncreasing in excess of the normal working temperature. For example, the definite value A corresponds to 3 hms.

At step 150, the value set in the target resistance value ariable RT (RTO at present) is interchanged with the alue set in the conservation variable RTW (RTO−A). Thereby, the target resistance value variable RT is set o an initial target resistance value (RTO−A), and the urrent supply to the heater 54 is controlled so that the eater resistance RH becomes equal to the initial target esistance value (RTO−A). The conservation variable RTW is set to the target resistance value RTO to be sed in the normal driving condition. The target resistance value RTO is held in the conservation variable RT until the heater 54 is controlled by a normal heater ontrol procedure.

At step 160, it is determined whether or not the value f current IHT passing through the heater 54 is equal to r smaller than a definite value IB. When IHT>IB, the ontrol proceeds to step 110 (FIG. 5B), which inhibits he current supply to the heater 54. This control is directed to limiting an inrushing current caused immediately after the power supply to the heater 54 is started nd relaxing the thermal shock due to the occurrence of he inrushing current. The current value IHT is calculated on the basis of the potential AD of the comparison esistance R1 by an HIT calculation routine, which will e described later with reference to FIG. 6.

When IHT≦IB at step 160, the control proceeds to tep 170, which calculates the resistance value RH of he heater 54 by the following formula:

$$RH = VB/IHT - RI$$

where VB is the battery voltage as described previously nd RI is a resistance value of the comparison resistor R1 (FIG. 4). The battery voltage VB is calculated by a VB calculating routine shown in FIG. 7, which will be described later. At step 180, it is determined whether or not the calculated heater resistance value RH is equal to r larger than the target resistance value RT (which is et to a low value equal to RTO−A at present). Since RH<RT is satisfied immediately after the current supply to the heater 54 is started, the control proceeds to tep 190 (FIG. 5B), which sets the variable YHT to 1. Thereby, the switching transistor Tr (FIG. 4) is turned ON, and current passes through the heater 54.

After that, it is determined at step 250 as to whether r not the flag X.RTW is 1. Since the flag X.RTW is eing reset to 0 during the first execution of the power upply control to the heater 54, the present routine is erminated.

On and after the second execution of the present outine, steps 130–150 are not executed and thus the arget resistance value is maintained equal to the lower esistance value RTO−A. In addition, RH<RT for a while. For these reasons, the heater 54 is successively eing supplied with current (step 190). During this time, f course, the current supply to the heater 54 is stopped f the heater current value IHT is larger than the limit value IB (steps 160, 110).

The sensor temperature increases due to the successive current supply. When RH≧RT, a process from step 200 is executed. At step 200, it is determined whether or not the flag X.RTW remains equal to 0. The flag X.RTW is set to 0 at step 130 and is maintained as it is. Thus, the control proceeds to step 210, which increases the value in the target resistance value variable RT by a predetermined small value DRT. That is, the value in the variable RT becomes equal to RTO−A+DRT. At step 220, it is discerned whether or not the increased value in the target resistance value variable RT becomes equal to or larger than the value in the conservation variable RTW (which is the target resistance value RTO in the normal driving condition). As DRT is much smaller than the definite value A, RT<RTW initially, the control proceeds to step 240, which sets the variable YHT to 0. Thereby, the current supply to the heater 54 is stopped.

The above-mentioned routine is repeatedly carried out a number of times, and the value in the target resistance value variable RT is increased by DRT each time the present routine is executed. At step 220, when the value of the variable RT becomes equal to or larger than the target variable resistance value RTW (=RTO) to be used under the normal driving condition at step 220, the control proceeds to step 230, which sets the flag X.RTW to 1. At this time, the target resistance value RT is completely shifted to the normal resistance value RTO. This represents that the initial stage of the current supply control (that is, the initial power supply control) is completed. After that, a processing from step 260 is executed without exception, and the normal heater control or normal power supply control is executed.

Step 260 is carried out in order to determine whether or not a learning control consisting of steps 270–290 should be executed. The learning control is directed to correcting the target resistance value RT in order to compensate for different resistance values for different heaters of individual oxygen sensors and a variation in resistance due to time deterioration thereof. For example, step 260 determines whether or not a condition (an idling condition) in which the idle switch 8 is ON (throttle valve is maintained closed), the vehicle speed is equal to or less than 5 km/h, and the coolant temperature is equal to or lower than 70° C., will be continuously maintained for a predetermined time (2 sec., for example).

When the above-mentioned condition is satisfied, the control proceeds to step 270, which calculates an average PN of power which has been supplied to the heater 54 for a predetermined time, such as a few seconds. Then, at step 280, a correction value ΔRT by which the target resistance value RT is corrected is calculated from the calculated average PN of supplied power. At subsequent step 290, the target resistance value RT is corrected by the calculated correction value ΔRT.

In the first embodiment, the heater 54 is turned ON or OFF at every execution cycle of the routine shown in FIGS. 5A and 5B (64 msec.). Thus, the average PN of supplied power is calculated by the following formula:

$$PN = \sum^{n} (P \cdot YHT)/n$$

where $$P = (VB \cdot IHT - IHT^2 \cdot RI).$$

Figure 8:
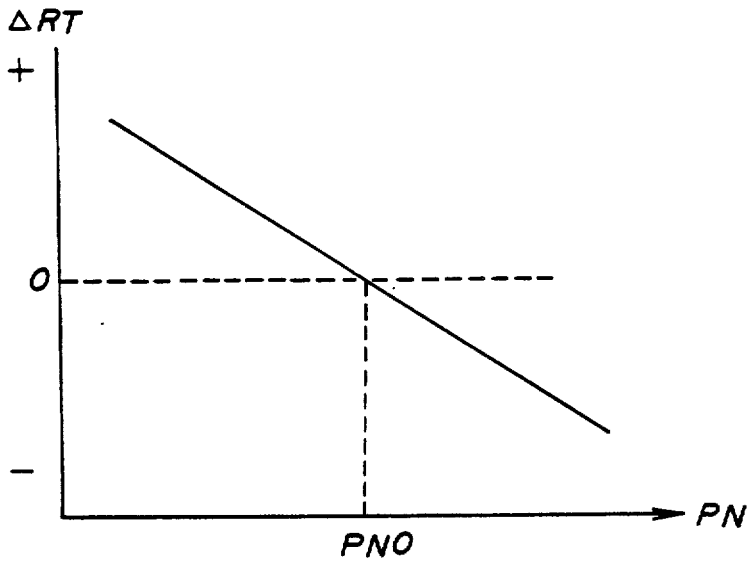
FIG. 8 is a graph representing a map used for calculating a correction value ΔRT for a target resistance value RT from the average power supplied to a heater of an oxygen sensor used in the engine shown in FIG. 3.

The process of step 280 where the correction value ΔRT is calculated based on the average PN of supplied power is done by referring to a map stored in the ROM 42. The map stored in the ROM 42 represents a graph of FIG. 8, in which the horizontal axis of the graph represents the average power PN and the vertical axis thereof represents the correction value ΔRT. It can be seen from the graph that the correction value ΔRT is zero when the average power PN is equal to a reference value PN0, and the correction value ΔRT is a minus value when the average power PN is larger than the reference value PN0.

Figure 6:
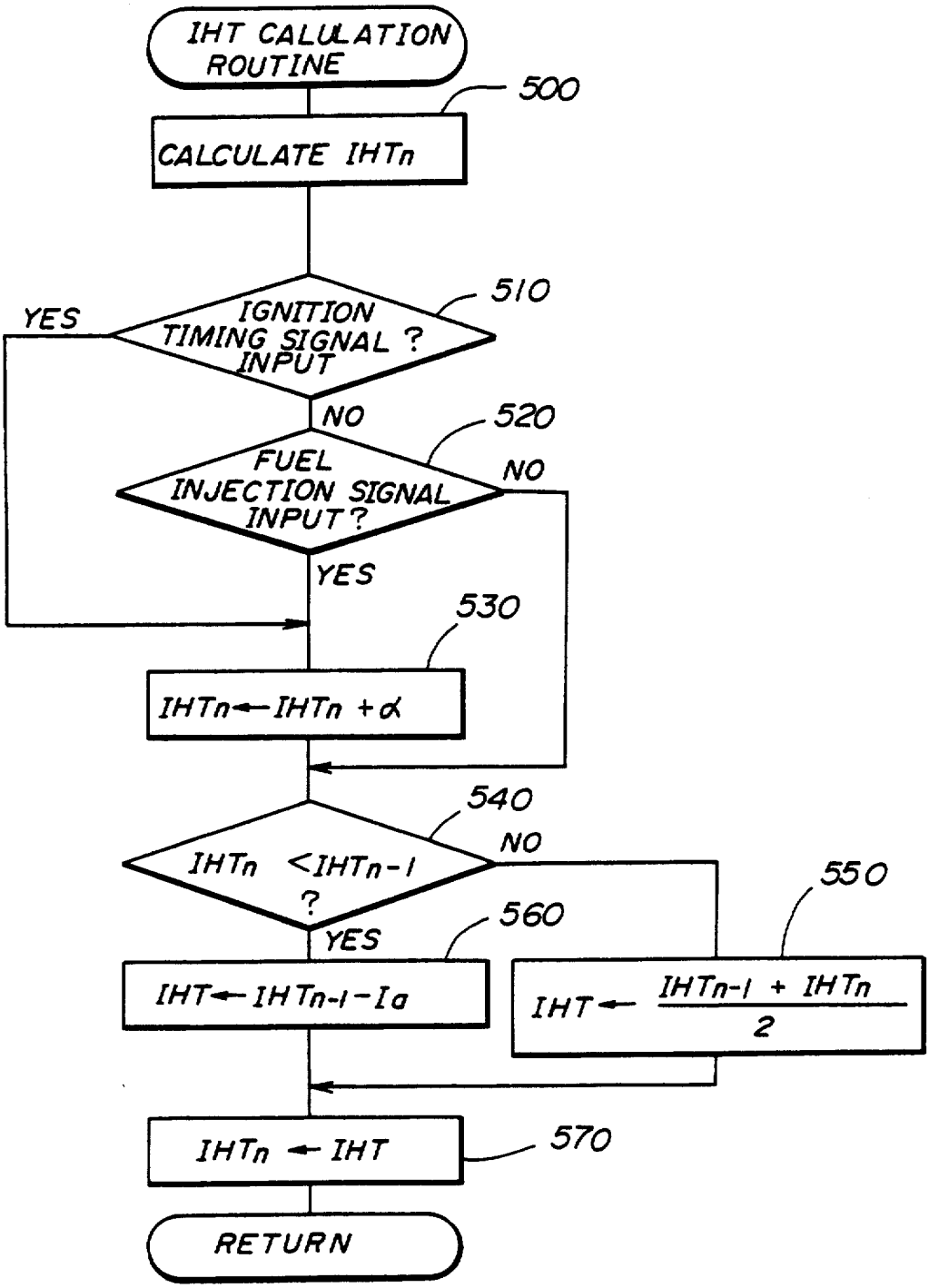
FIG. 6 is a flowchart illustrating an IHT calculation routine.
Figure 9:
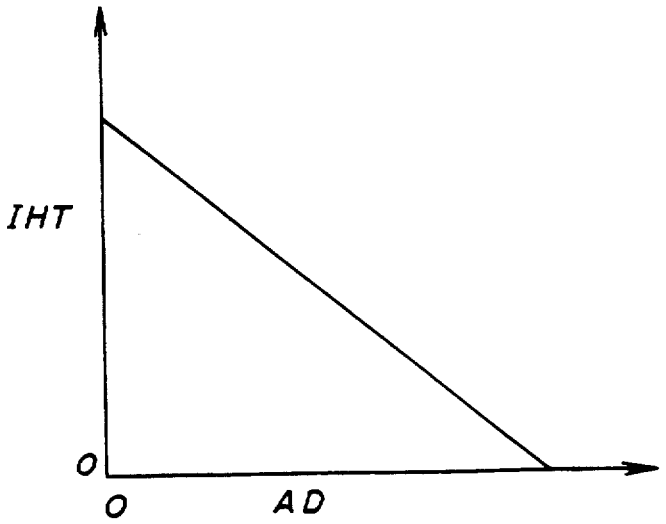
FIG. 9 is a graph representing a map used for calculating a heater current from a voltage across a comparison resistance shown in FIG. 4.

A description will be given of the IHT calculation routine which calculates the value of the current passing through the heater 54, with reference to FIG. 6. The IHT calculation routine is executed each time the heater 54 is intentionally supplied with power at every predetermined time period, such as 65 msec. At the commencement of the IHT calculation routine, step 500 inputs the potential AD of the comparison resistor R1 supplied from the operational amplifier 56 and calculates a current heater current value IHTn based on the input potential AD by referring to the map shown in FIG. 9. At subsequent step 510, it is determined whether or not the aforementioned ignition timing signal is being input. When the ignition timing signal is not being input, the control proceeds to step 520, which determines whether or not the aforementioned fuel injection signal is being input.

When it is decided at step 520 that the fuel injection signal is being input or when it is judged at step 510 that the ignition timing signal is being input, the control proceeds to step 530, which renews the heater current value IHTn by adding a predetermined value α to the present heater current value IHTn. The process of steps 510–530 is directed to correcting a fluctuation in the heater current value IHTn due to a variation in the battery voltage VB. It is noted that when ignition or fuel injection is carried out on the engine side, the battery voltage VB changes (decreases) greatly so that the heater current value IHTn calculated at step 500 becomes smaller than a heater current value obtained when the normal battery voltage VB is applied to the heater 54.

When the heater current value IHTn is corrected at step 530 or when the result at step 520 is negative, the control proceeds to step 540, which compares the heater current value IHTn calculated by the abovementioned procedure with a heater current value IHTn-1 obtained by the previous execution of the present routine. When IHTn≧IHTn−1, the control proceeds to step 550, which calculates the heater current value IHT used for the heater control by the aforementioned heater control processing routine, using the following formula:

$$IHT=(IHTn+IHTn-1)/2$$

On the other hand, when IHTn<IHTn−1, the control proceeds to step 560, which sets the heater current value IHT to a value obtained by subtracting a predetermined value Ia from the previously calculated heater current value IHTn-1. Then the control proceeds to step 570, which uses the value IHT obtained in step 550 or 560 as the heater current value IHTn. Then the control is terminated.

It is noted that the process of steps 540–560 is directed to preventing an erroneous heater control which may take place when the heater current value INTn calculated at step 500 has an error. That is, normally, the heater current does not change greatly for the predetermined time (65 msec., for example). Thus, a sudden fluctuation in the heater current IHT is absorbed and thus weakened by the process of steps 540–560.

In the first embodiment, when the current heater current value IHT is larger than the previous one, IHTn−1, the average thereof is calculated at step 550. On the other hand, when the present heater current value IHT is smaller than the previous one, IHTn−1, , the heater current value IHT for the next cycle is calculated at step 560 by subtracting the predetermined value Ia from the present heater current value IHT. This is because a decrease of the heater current value IHT represents an increase of the heater resistance RH and thus the current supply is directed toward OFF. For this reason, when the heater current IHT tends to decrease, the heater current IHT is gradually decreased by subtracting the predetermined value Ia from the previous heater current value IHTn−1 so that the trend toward heater OFF is prevented from being accelerated.

Figure 7:
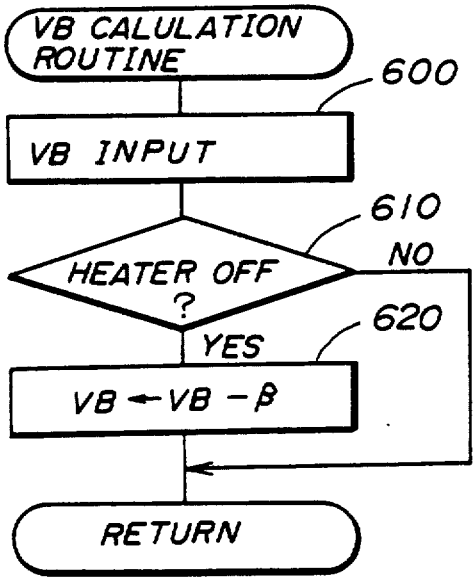
FIG. 7 is a flowchart illustrating a VB calculation routine.

A description will be given of the VB calculation routine for calculating the battery voltage VB with reference to FIG. 7. The VB calculation routine is executed at every predetermined time period (115 msec., for example) which is longer than that for the aforementioned IHT calculation routine. The VB calculation routine commences to execute step 600, which inputs the battery voltage VB supplied through the A/D converter 57 (FIG. 4). At subsequent step 610, it is determined whether or not the current supply to the heater 54 is being stopped at present. When the result at step 610 is affirmative, the control proceeds to step 620, which subtracts a predetermined value β from the battery voltage VB input at step 600, and uses a resultant value as the battery voltage VB used for the control. On the other hand, when the result at step 610 is NO, the control is terminated. It is noted that the heater current value IHT is obtained by passing a current through the heater 54, and the battery voltage VB obtained when the current passes through the heater 54 is smaller than that obtained when no current passes through the heater 54. From this point of view, the predetermined value β is subtracted from the battery voltage VB which is input at step 600 in the state where no current passes through the heater 54 so that it corresponds to a value which would be obtained in the case where a current passes through the heater 54. Thereby, the precise value of the heater resistance RH can be obtained by the heater control processing routine.

A description will be given of an example of the power supply control in the heater 54 to the first embodiment with reference to FIG. 10. When the activation of the engine 1 by the use of the starter motor 61 (FIG. 3) is completed (at time $t_1$), it is decided that the current or power supply to the heater 54 becomes possible (step 100 in FIG. 5A). Thereby, the target resistance value RT is set to RTO−A and the current supply to the heater 54 is started. The resistance value RH of the heater 54 is small at the initial stage of the current supply and thus a large current passes through the heater 54. As a result, the current supply to the heater 54 is frequently stopped as indicated by a waveform representing the values set in the variable YHT. The heater resistance value RH obtained at time $t_2$ is quite large; however smaller than the target resistance value RT.

Thus, after time $t_2$, the heater current value IHT is always larger than the limit value IB for a while so that current continuously passes through the heater 54.

During this time, the temperature of the sensor element of the oxygen sensor 20 increases rapidly, and simultaneously the heater resistance RH increases. At time $t_3$, the heater resistance value RH exceeds the target resistance value RT (its initial value is RTO−A), and the current supply to the heater 54 is stopped at once. Since the value A is predetermined as described previously, the temperature of the sensor element approximately reaches the normal working temperature at time $t_3$, as indicated by RH1 shown in FIG. 10. After that, the current supply to the heater 54 is intermittently and repeatedly carried out, while the target resistance value RT increases by DRT each time the routine shown in FIGS. 5A and 5B is executed (at every 64 msec.). Thereby, the temperature of the mounting portion of the oxygen sensor 20 gradually increases and approaches an equilibrium temperature at time $t_4$ as indicated by RH2 shown in FIG. 10.

The value of DRT is predetermined taking into account the resistance increasing speed of the resistance value RH2 obtained after the sensor element of the oxygen sensor 20 reaches the normal working temperature. For example, the value DRT is selected so that an increase of the resistance value RH2 corresponds to an increase of the temperature of the mounting portion of the oxygen sensor 20 obtained when the vehicle is normally moving at a speed of 80 km/h. Alternatively, the value DRT may be selected on the basis of the driving condition and/or temperature. In FIG. 10, there is shown a one-dotted chain line which represents a temperature change obtained when a control such as the control employed in the first embodiment is not employed, or in other words, the target resistance value RT is not corrected with the definite value A. It can be seen from FIG. 10 that the temperature of the sensor element increases rapidly at the initial stage of the controlling process, and overshoots.

In short, according to the first embodiment, the target resistance value RT to be set at the initial stage of the current supply control (initial current supply control) to the heater 54 is set to a value obtained by subtracting the definite value A from the normal target resistance value RTO. After the heater resistance value RH reaches the target resistance value RT, the target resistance value RT is gradually increased stepwise until the target resistance value RT reaches the normal resistance value RTO. During the time when the target resistance value RT is smaller than the normal resistance value RTO, power supplied to the heater 54 is suppressed (decreased) as compared with in the case of the normal operation. By the above-mentioned power supply control, it becomes possible to prevent the temperature of the sensor element of the oxygen sensor 20 from increasing in excess of the target temperature.

Alternatively, it is possible to control the power supply to the heater 54 instead of correcting the target resistance value RT as described previously.

Figure 11A:
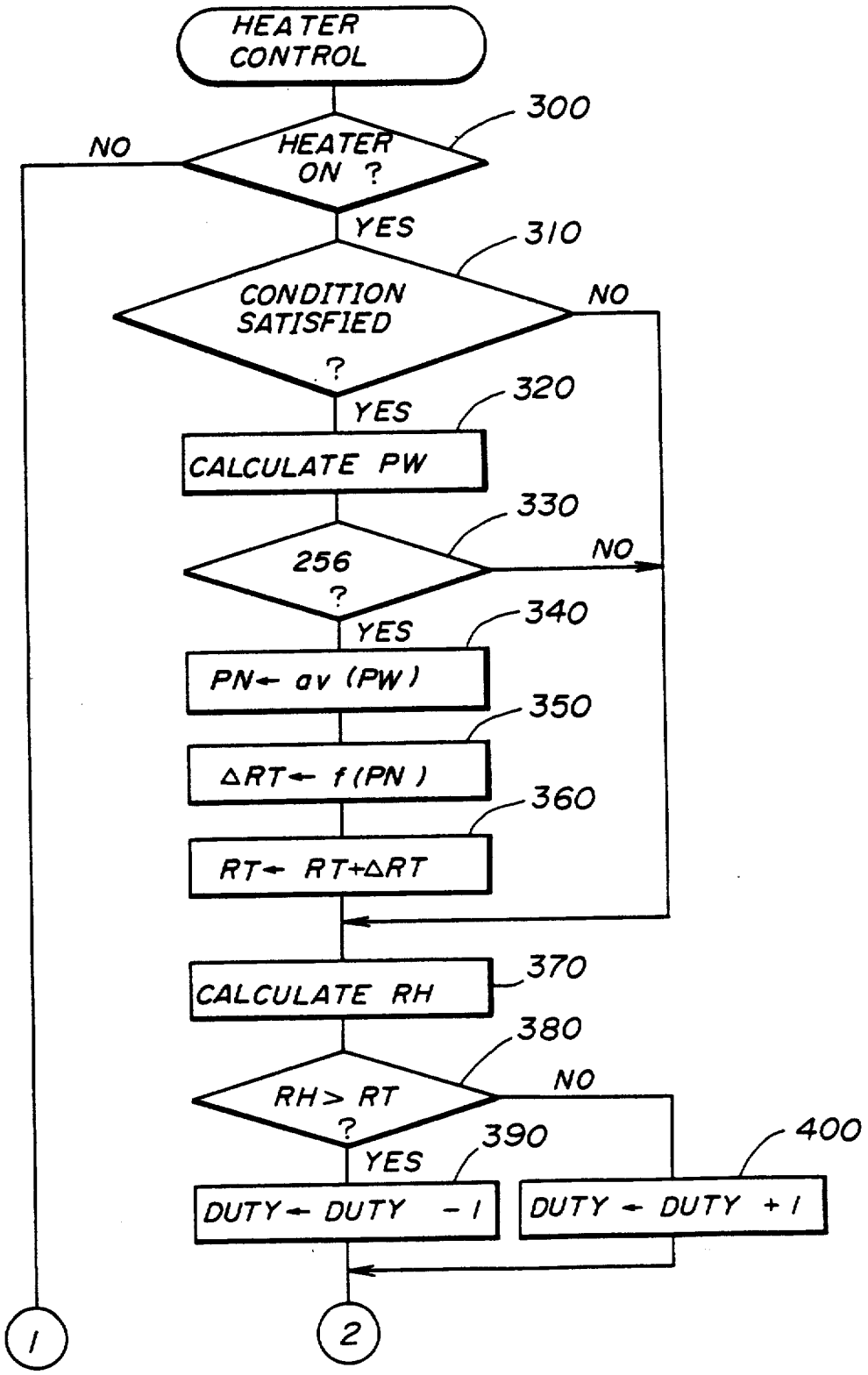
FIGS. 11A and 11B are flowcharts illustrating the heater control processing routine according to a second embodiment of the present invention.
Figure 11B:
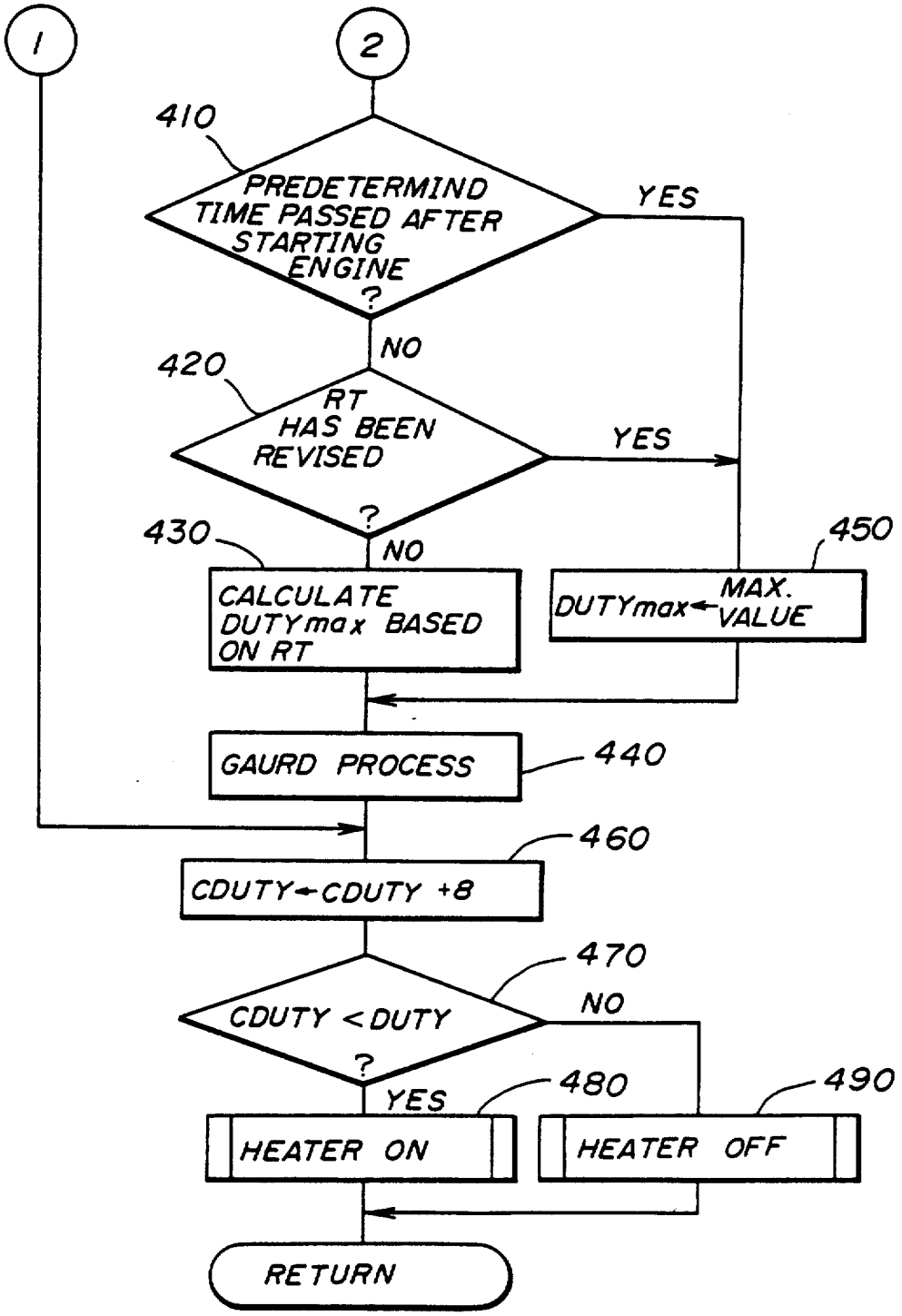

A description will be given of a second preferred embodiment of the present invention with reference to FIGS. 11A and 11B. The second embodiment of the present invention employs a heater control process routine which controls the heater 54 by controlling the current supply time during which current is being supplied to the heater 54 or the switching transistor (FIG. 4) is held ON. The heater control process routine according to the second embodiment is executed by the CPU 41 every 16 msec., when the execution condition on the current supply control to the heater 54 is satisfied by a decision making process such as the aforementioned step 100 process. In the heater control process routine according to the second embodiment, the power supply control to the heater 54 is performed by a duty-ratio control in which the switching transistor Tr (FIG. 4) is repeatedly turned ON and OFF at every predetermined time period.

At step 300 of the present routine, it is determined whether power is being supplied to the heater 54. When the result at step 300 is YES, the control proceeds to step 310, which determines whether the learning condition on the target resistance value RT is satisfied in the same manner as the aforementioned step 260. When the result at step 310 is YES, the control proceeds to step 320, which calculates the amount of power being supplied to the heater 54 in accordance with the following formula:

$$PW=(VB\cdot IHT-IHT^2\cdot RT)(\mathrm{DUTY}/256)$$

where DUTY is the value of a counter corresponding to a duty-ratio which will be described in detail later. At step 330, it is determined whether or not the power calculation procedure of step 320 has repeatedly been carried out 256 times. When the result at step 330 is YES, the control proceeds to step 340, which calculates the average av(PW) of the 256 calculated values PW of power supplied to the heater 54. At steps 350 and 360, the target resistance value RT is renewed as in the case of the aforementioned steps 280 and 290.

On the other hand, when the result at step 310 or 330 is NO, the control proceeds to step 370, which calculates the resistance value RH of the heater 54 in the same manner as the aforementioned step 170.

Figure 12:
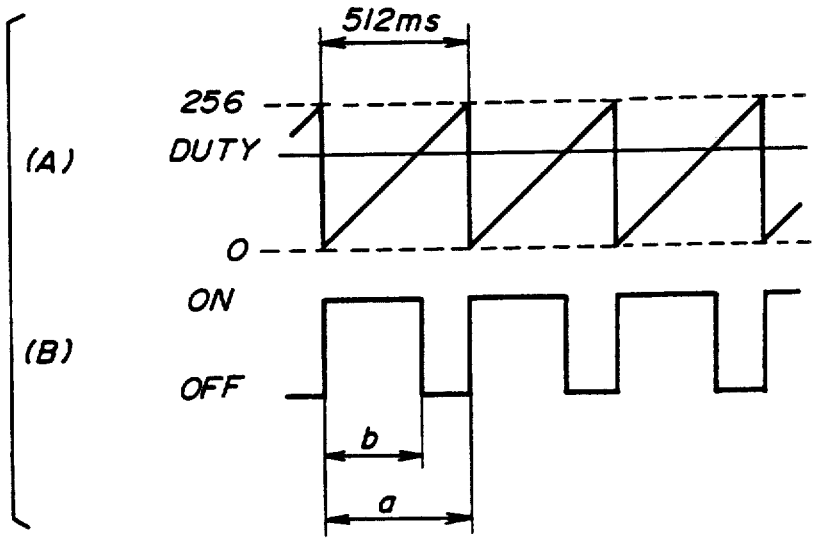
FIG. 12 is a time chart illustrating a current supply control to the heater according to the second embodiment.

At steps 380–400, the value in the duty-ratio associated counter DUTY is incremented or decremented by 1 on the basis of whether the heater resistance value RH is larger, or equal to or smaller than the target resistance value RT. As shown in FIG. 12, the counter DUTY represents the ratio of the ON time (b) to the ON/OFF cycle time (a), that is, a value corresponding to the duty ratio (b/a×100%). In the second embodiment, the counter DUTY assumes any of values of 0–256 so as to correspond to a free-running counter CDUTY which will be described later.

Figure 13:
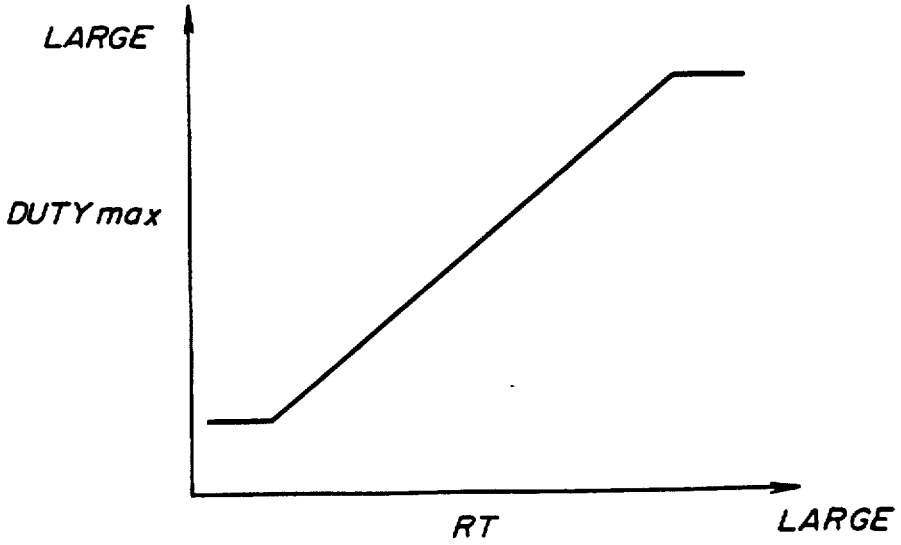
FIG. 13 is a graph representing a map used for calculating an upper-limit value DUTYmax based on the target resistance value RT.

After setting the value of the counter DUTY, the control proceeds to step 410, which determines whether or not a predetermined time (350 sec., for example) passes after starting the engine 1. When the predetermined time has not yet passed, the control proceeds to step 420, which determines whether the target resistance value RT was renewed at the aforementioned step 360. When the result at step 420 is NO, the control proceeds to step 430, which calculates bu using the map shown in FIG. 13, based on the target resistance value RT, DUTYmax which represents an upper limit of the possible counter value DUTY. Then the control proceeds to step 440.

On the other hand, when it is found that the predetermined time has passed at step 410, or when it is found that the target resistance value RT was renewed at step 420, the control proceeds to step 450, which sets the upper-limit value DUTYmax to the maximum value equal to 256 (corresponding to the 100% duty ratio). At subsequent step 440, a guard process is executed in which the counter value DUTY is not out of the range between the upper-limit value DUTYmax set at steps 430 or 450 and a preset lower-limit value DUTYmin (=8 corresponding to a duty ratio of 3.125%).

The process of steps 410–430 is directed to setting the upper-limit value DUTYmax to a value smaller than 256 in accordance with the target resistance value RT until the predetermined time passes after starting the engine 1 or the target resistance value RT is renewed so that current supply time (that is, supplied power) to the heater 54 is reduced as compared with a normal supply time (power).

It is sufficient to execute the guard process until the target resistance value RT is renewed because the learning condition on the target resistance value RT is certainly satisfied at that time. Even if the target resistance value RT has not yet been renewed, when the predetermined time (350 sec. in the present embodiment) passes, the engine 1 will have been warmed up sufficiently. That is, the temperature of the mounting portion of the oxygen sensor 20 will have been sufficiently increased at that time, and thus the temperature of the sensor element thereof does not increase in excess of the target temperature. The process of steps 420 and 430 distinguishes the normal driving condition from the other conditions on the basis of the passage time after starting the engine 1 as well as the status of the target resistance value RT.

As described previously, the upper-limit value DUTYmax is selected based on the target resistance value RT when the aforementioned learning condition is not satisfied. This is based on the following. That is, the target resistance value RT is selected so as to compensate for different resistance values for different heaters of individual oxygen sensors and a variation in resistance due to time deterioration by the past learning control. When the target resistance value RT is large, the caloric power of the heater 54 is small with respect to power supplied thereto. On the other hand, when the target resistance value RT is small, the caloric power of the heater 54 is large with respect to power supplied thereto. That is, according to the second embodiment, the smaller the target resistance value RT, the smaller the upper-limit value DUTYmax is set so that a large reduction of power supplied to the heater 54 is carried out when it has a large caloric power.

After executing the guard process for the value in the counter DUTY, the control proceeds to step 460, which increments the free-running counter CDUTY by 8. At subsequent step 470, the value in the counter CDUTY is compared with the value in the counter DUTY. When DUTY>CDUTY, the heater 54 is turned ON at step 480. On the other hand, when DUTY≦CDUTY, the heater 54 is turned OFF at step 490. It is noted that the free-running counter CDUTY is reset to 0 when reaching 256. The process at step 460 is executed when it is judged at step 300 that no current or power is not being supplied (OFF). The process of steps 460–490 turns ON and OFF at a predetermined cycle, such as 512 msec. (=16 msec. ×(256/8)) so that the duty ratio is selected in accordance with the value in the counter DUTY.

The present invention is not limited to the aforementioned embodiments, and variations and modifications may be made without departing from the scope of the present invention.

What is claimed is:

1. An apparatus for controlling a heater for heating an oxygen sensor provided in an exhaust gas flow passage of an internal combustion engine disposed in an automotive vehicle comprising:

detecting means for detecting a driving condition parameter of said automotive vehicle;

decision means for determining, from a driving condition represented by said driving condition parameter detected by said detecting means, whether or not a power supply control to said heater should be executed; and power supply control means for supplying, during a predetermined period of time, said heater with an amount of power which is smaller than that to be supplied thereto in a normal driving condition when it is determined that said power supply control to said heater should be executed by said decision means so that a resistance value of said heater is controlled to a target resistance value.

2. An apparatus as claimed in claim 1, further comprising measuring means for measuring the temperature of a sense portion of said oxygen sensor sensitive to an oxygen component, wherein said power supply control means comprises control means for controlling the amount of power to be supplied to said heater so that the temperature of said sense portion of said oxygen sensor is always lower than a target temperature during said predetermined period so that the resistance value of said heater is controlled as to be equal to said target resistance value.

3. An apparatus as claimed in claim 1, further comprising measuring means for measuring the resistance value of said heater, wherein said target resistance value is switched between a first target resistance value and a second resistance value, and wherein said power supply control means comprises control means for controlling the amount of power to be supplied to said heater so that the resistance value of said heater becomes equal to said first target resistance value and then becomes equal to said second target resistance value which is larger than said first target resistance value after the resistance value becomes equal to said first target resistance value.

4. An apparatus as claimed in claim 3, wherein said second target resistance value is a value to be set in said normal driving condition.

5. An apparatus as claimed in claim 3, further comprising means for providing stepwise increasing target resistance values which are larger than said first target resistance value and are smaller than said second target resistance value, wherein said control means controls the amount of power to be supplied to said heater so that the resistance value of said heater successively becomes equal to each of said stepwise increasing target resistance values until the resistance value of said heater becomes equal to said second target resistance value.

6. An apparatus as claimed in claim 3, wherein said first target resistance value relates to a difference in temperature increasing speed between a sense portion of the oxygen sensor sensitive to an oxygen component and a mounting portion thereof which is fastened to said exhaust gas flow passage.

7. An apparatus as claimed in claim 1, wherein said power supply control means comprises a battery selectively connected to said heater, and said decision means comprises first means for determining whether or not a starter motor provided for said internal combustion engine is operating, second means for determining whether or not a voltage of said battery is equal to or higher than a predetermined battery voltage, and third means for determining whether or not the temperature of a coolant for cooling said internal combustion engine is equal to or higher than a predetermined coolant temperature, and wherein when the results obtained from said first, second and third means are all affirmative, said decision means decides that the power supply control should be executed.

8. An apparatus as claimed in claim 1, wherein said power supply control means comprises a battery, switching means coupled to said battery for selectively coupling said battery to said heater so that the amount of power which is smaller than the amount of power to be supplied to said heater in said normal driving condition is supplied thereto.

9. An apparatus as claimed in claim 1, wherein said power supply control means comprises a battery, and control means for controlling a current supply time during which a current supplied from said battery is supplied to said heater.

10. An apparatus as claimed in claim 1, wherein said power supply control means comprises a battery, switching means for selectively coupling said battery to said heater in accordance with a control pulse, and duty ratio control means for controlling a duty ratio of said control pulse so that said heater is supplied with an amount of power which is smaller than the amount of power to be supplied to said heater in said normal driving condition.

11. An apparatus as claimed in claim 10, wherein said duty ratio control means comprises means for controlling the duty ratio of said control pulse so as to be smaller than a normal duty ratio which is to be set in said normal driving condition.

12. An apparatus as claimed in claim 11, wherein said duty ratio control means comprises means for providing, during said predetermined period, an upper-limit value of the duty ratio which is smaller than an upper-limit value of the duty ratio which is to be set in said normal driving condition.

13. An apparatus as claimed in claim 10, further comprising means for determining whether said internal combustion engine is sufficiently warmed up on the basis of said driving condition parameter detected by said detecting means, wherein said duty ratio control means controls the duty ratio of said control pulse so that said heater is supplied with an amount of power which is smaller than the amount of power to be supplied to said heater in said normal driving condition until said internal combustion engine is sufficiently warmed up.

14. An apparatus as claimed in claim 10, further comprising measuring means for measuring a resistance value of said heater, and means for determining whether said resistance value of said heater measured by said measuring means becomes larger than a target resistance value which is to be set in said normal driving condition, wherein said duty ratio control means controls the duty ratio of said control pulse so that said heater is supplied with an amount of power which is smaller than the amount of power to be supplied to said heater in said normal driving condition until the resistance value of said heater becomes equal to said target resistance to be set in said normal driving condition.

15. An apparatus as claimed in claim 1, wherein said power supply control means includes means for controlling the amount of power to the amount of power in the normal driving condition after said power supply control is completed.

16. An apparatus as claimed in claim 1, wherein said decision means determines, at every predetermined period of time, whether or not the power supply control to said heater should be executed.

17. An apparatus as claimed in claim 1, wherein said oxygen sensor detects a concentration of an oxygen component contained in said exhaust gas flow passage.

* * * * *